US008028863B2

(12) United States Patent
Duquet et al.

(10) Patent No.: US 8,028,863 B2
(45) Date of Patent: Oct. 4, 2011

(54) FLUID DISPENSER MEMBER

(75) Inventors: Frédéric Duquet, Thibouville (FR); Hervé Pennaneac'h, Piseux (FR); Jean-Paul Lecoutre, Conde sur Iton (FR)

(73) Assignee: VALOIS SAS, Le Neubourg (FR)

( * ) Notice: Subject to any disclaimer, the term of this patent is extended or adjusted under 35 U.S.C. 154(b) by 511 days.

(21) Appl. No.: 12/178,266

(22) Filed: Jul. 23, 2008

(65) Prior Publication Data

US 2009/0026224 A1 Jan. 29, 2009

Related U.S. Application Data

(60) Provisional application No. 60/977,832, filed on Oct. 5, 2007.

(30) Foreign Application Priority Data

Jul. 24, 2007 (FR) ..... 07 56691

(51) Int. Cl.
*B65D 88/54* (2006.01)

(52) U.S. Cl. ..... 222/321.2; 222/340

(58) Field of Classification Search ..... 222/321.2, 222/321.1, 321.6–321.9, 340, 154, 383.1, 222/380, 381; 329/333, 320, 321, 350, 472, 329/492

See application file for complete search history.

(56) References Cited

U.S. PATENT DOCUMENTS 3,482,784 A * 12/1969 Webster ..... 239/493
4,050,613 A * 9/1977 Corsette ..... 222/321.2
4,111,367 A * 9/1978 Hayes ..... 239/333
4,511,065 A * 4/1985 Corsette ..... 222/153.13
7,182,225 B2 * 2/2007 Garcia et al. ..... 222/321.3

FOREIGN PATENT DOCUMENTS

FR 2 363 712 A1 3/1978
FR 2 547 365 A1 12/1984
WO 2005/084820 A1 9/2005

* cited by examiner

*Primary Examiner* — Lien T Ngo
(74) *Attorney, Agent, or Firm* — Sughrue Mion, PLLC

(57) ABSTRACT

A fluid dispenser member comprising a dispenser wall (23) defining an outside surface (231) and an inside surface (232), said wall (23) having a dispenser orifice (24) passing therethrough, connecting the inside surface to the outside surface, the inside surface (232) forming a sealing slide-cylinder (233) for a piston (3) that is suitable for being displaced, from a rest position, along an axis X in said cylinder and with leaktight contact, so as to open an outlet valve (25, 35), said piston (3) forming a portion of a fluid chamber (20) in which fluid is selectively put under pressure and flows through the open outlet valve towards the dispenser orifice, the piston forming a closure wall (34) that is suitable for closing the dispenser orifice (24) in the rest position, the closure wall (34) being positioned, in the rest position, over the dispenser orifice (24) beside its inside surface (232), the closure wall (34) coming into leaktight contact with the inside surface (232), the dispenser member being characterized in that, at the dispenser orifice (24), the inside surface (232) slopes relative to the displacement axis X of the piston (3), and the closure wall (34) of the piston (3) slopes in a manner that substantially corresponds to the inside surface (232), so as to create a cone-on-cone contact.

10 Claims, 2 Drawing Sheets

FLUID DISPENSER MEMBER

CROSS REFERENCE TO RELATED APPLICATION

This application claims the benefit under 35 U.S.C. §119(e) of U.S. provisional patent application Ser. No. 60/977,832, filed Oct. 5, 2007, and priority under 35 U.S.C. §119(a)-(d) of French patent application No. FR-07.56691, filed Jul. 24, 2007.

TECHNICAL FIELD

The present invention relates to a fluid dispenser member that is generally associated with a fluid reservoir, which together constitute a fluid dispenser. It relates to a dispenser member that is generally actuated manually by means of a finger of the user. The fluid is dispensed in the form of a jet of fine spray droplets, a continuous stream, or even a knob of fluid, particularly for viscous fluids, such as cosmetic creams. Such a fluid dispenser member can be used in particular in the fields of perfumery, cosmetics, or even pharmacy for dispensing fluids that are viscous to a greater or lesser extent.

BACKGROUND OF THE INVENTION

The present invention relates more particularly, but not exclusively, to a type of dispenser member that is commonly known as a "pusher-pump". Such a term is explained by the fact that the dispenser member includes a pusher that forms not only a dispenser orifice, but also defines a portion of a fluid chamber in which the fluid is put under pressure in selective manner. For a pump, said portion is a pump chamber. A distinctive feature of that pusher-pump resides in the fact that an inside surface of the pusher, of generally substantially cylindrical shape, serves as a sealing slide-cylinder for a piston that moves with leaktight contact inside the cylinder, thereby opening and closing an outlet valve. In general, the piston is a piston of the differential type that moves in response to a variation in the pressure of the fluid inside the chamber.

Such a fluid dispenser member of the pusher-pump type is known in particular from document WO 2005/084820. The dispenser member is specially adapted to fluids that are not very viscous, such as perfumes, and that are desirably dispensed in the form of a spray. The dispenser member in that document is not adapted in any way to dispensing viscous fluids such as creams or gels that are generally dispensed in the form of streams or knobs. The piston of the differential type includes a first valve lip that slides in leaktight manner in a cylinder formed by the pusher, and a second lip that is engaged in another cylinder, referred to as a "main" cylinder, formed by the body of the dispenser member. The lip in sliding contact in the pusher can be referred to by the term "differential lip" or "outlet valve", whereas the lip that slides in leaktight manner in the main cylinder of the body can be referred to by the term "main lip". In addition, the pusher includes a dispenser orifice upstream from which there is formed a swirl system that is provided in the form of tangential channels that connect to a central swirl chamber that is centered on the dispenser orifice. The outlet valve is not formed directly by the valve lip, but by a small ring that extends the valve lip, and that is for coming into leaktight bearing contact against an outlet-valve seat of frustoconical shape. By displacing the differential piston relative to the pusher, the leaktight contact between the valve ring and its frustoconical seat is broken, and the fluid that has been put under pressure in the pump chamber of the dispenser member can thus escape towards the swirl system and the dispenser orifice. The fluid is prevented from escaping, or, more precisely, is constrained to be dispensed through the dispenser orifice as a result of the presence of the leaktight contact between the valve lip and the inside of the pusher forming the slide cylinder.

As explained, the above-mentioned document is particularly adapted to dispensing perfume. When it is desired to dispense viscous fluids such as creams, pastes, or gels, it is necessary to reduce, as much as possible, the degree to which the fluid to be dispensed comes into contact with the outside air, which can deteriorate the fluid by oxidization or by drying out. In the above-mentioned prior-art dispenser member, the fluid that is downstream from the outlet valve communicates with the outside through the dispenser orifice. This applies in particular for the fluid that is stored in the swirl system, namely in the tangential channels and in the central chamber. This is not acceptable for a dispenser member for dispensing fluids such as creams, pastes, or gels.

It is for example known from U.S. Pat. No. 4,511,064 a pump comprising a piston sliding against an inside surface of a dispenser wall forming a dispensing spout extending laterally. The spout forms an inner duct ending with a dispensing orifice. The piston closes at rest the inlet of the inner duct. The inside surface is cylindrical, so that the piston has to move on a determined distance before opening the inlet of the duct. This provides a precompression of the fluid product, which is thus expelled through the inner duct with a great pressure. This is no desired when dispensing viscous products, such as creams, pastes or gels. In fact, the product must not be projected out of the dispensing orifice. On the contrary, it must form a nut or a large droplet which is easily collectable by the user.

BRIEF SUMMARY OF THE INVENTION

An object of the present invention is to remedy the above-mentioned prior-art drawbacks by defining a dispenser member for pasty fluids (creams, pastes, gels) that has the same overall architecture (differential piston), but without suffering from problems of the fluid dispensing and deteriorating at the dispenser orifice.

To achieve this object, the present invention proposes a fluid dispenser member comprising a dispenser wall defining an outside surface and an inside surface, said wall having a dispenser orifice passing therethrough, connecting the inside surface to the outside surface, the inside surface forming a sealing slide-cylinder for a piston that is suitable for being displaced, from a rest position, along an axis X in said cylinder and with leaktight contact, so as to open an outlet valve, said piston forming a portion of a fluid chamber in which fluid is selectively put under pressure and flows through the open outlet valve towards the dispenser orifice, the dispenser member being characterized in that the piston forms a closure wall that is suitable for closing the dispenser orifice in the rest position. In the rest position, the closure wall is advantageously positioned over the dispenser orifice beside its inside surface. In the rest position, the closure wall preferably comes into leaktight contact with the inside surface. Contrary to the above-mentioned prior-art document, the piston comes directly into leaktight contact with the peripheral edge of the dispenser orifice at the inside surface. There is no gap between the closure wall and the dispenser orifice, as in the prior-art document, in particular with the presence of the swirl system.

According to an advantageous characteristic of the invention, at the dispenser orifice, the inside surface slopes relative to the displacement axis X of the piston. In addition, the closure wall of the piston may slope in a manner that substantially corresponds to the inside surface, so as to create a cone-on-cone contact. The closure wall can thus come into completely leaktight contact with the inside surface in which the dispenser orifice is formed, without any risk of jamming. The leaktight contact is not achieved cylinder-on-cylinder, but cone-on-cone.

According to another advantageous characteristic of the invention, at the dispenser orifice, the outside surface slopes relative to the axis X. This makes it possible to direct the dispenser orifice upwards a little, thereby imparting a generally attractive appearance to the pusher. In addition, this makes it possible to reduce the wall thickness of the dispenser wall at the dispenser orifice. However, this thinner wall can be obtained by other means. By reducing the wall thickness in this way, the depth of the dispenser orifice is also reduced, and consequently so is the quantity of fluid stored at the orifice.

In another aspect of the invention, the piston forms a movable outlet-valve member for coming into leaktight contact against an outlet-valve seat. A fluid passage is advantageously defined between the open outlet valve and the dispenser orifice, the passage being substantially filled in by the piston in the rest position, so as to reduce the dead volume. In another advantageous aspect, the piston is a differential piston that is displaced in response to a variation in the pressure in the fluid chamber. The dispenser wall is advantageously formed by a pusher such that the piston slides in the pusher, the outlet valve including a seat that is formed by the pusher. In a practical embodiment, the pusher may comprise a bearing wall and a substantially-cylindrical peripheral skirt, the dispenser wall being formed by the skirt, the skirt including a bottom end that is engaged in an axial guide bushing that advantageously serves as a support for a protective cap.

An advantageous principle of the invention is to use the piston of a pusher-pump as a closure member for internally closing the dispenser orifice, so as to avoid any risk of the fluid deteriorating. The piston thus fulfils a plurality of functions, namely those of a main piston, a valve piston, a movable valve member, and a closure member for closing the dispenser orifice.

BRIEF DESCRIPTION OF THE DRAWINGS

The invention is described more fully below with reference to the accompanying drawings which show an embodiment of the invention by way of non-limiting example.

In the figures.

DETAILED DESCRIPTION

Figure 1:
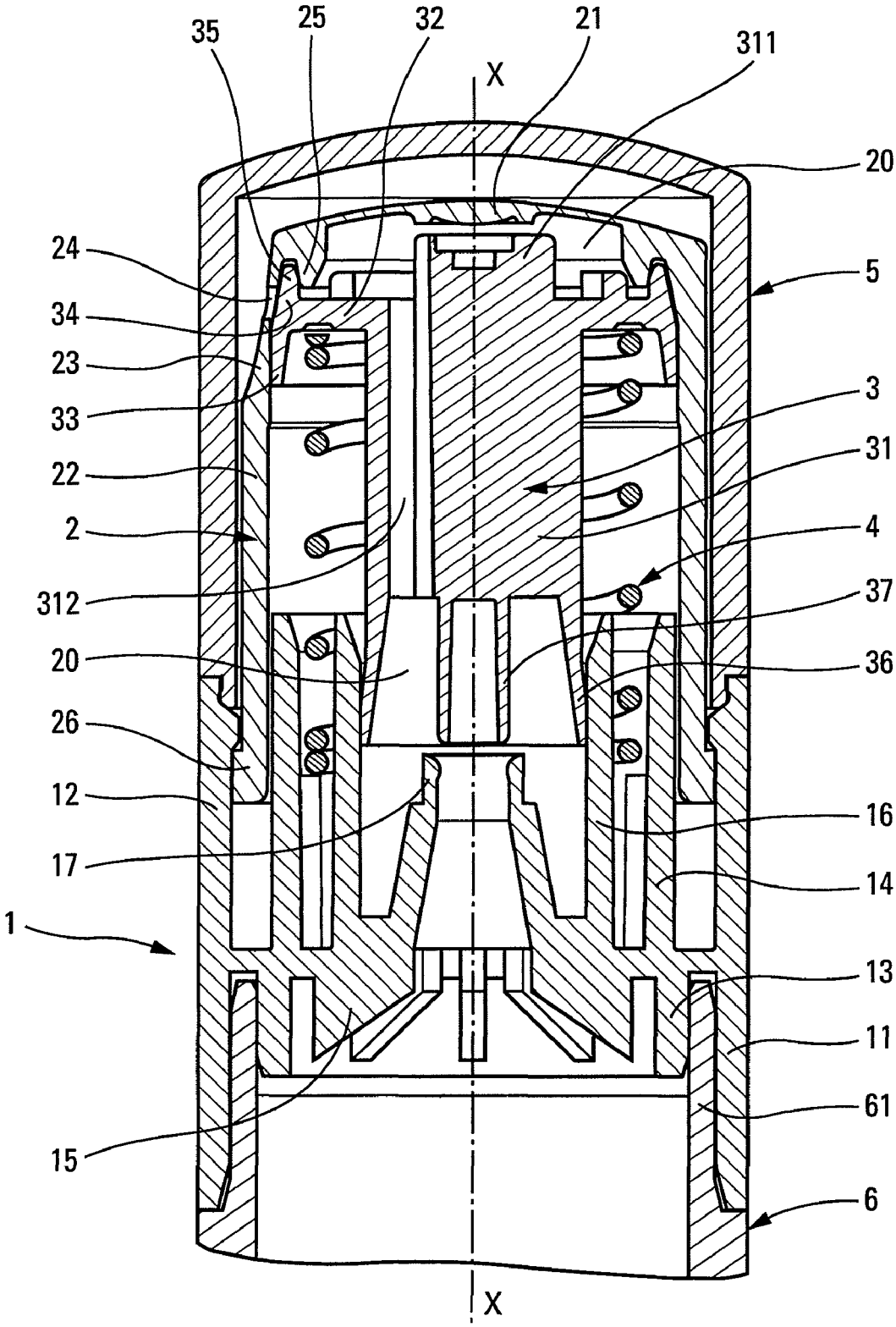
FIG. 1 is a vertical section view through a fluid dispenser member of the invention mounted on a reservoir.

Reference is made firstly to FIG. 1 in order to explain in detail the general structure of a fluid dispenser member of the invention that is associated with a reservoir 6 in such a manner as to form a fluid dispenser. The dispenser member shown and described is more particularly adapted to dispensing pastes such as cosmetic creams or gels. It can also be used for dispensing less viscous fluids, such as perfumes, although it is not specially adapted thereto.

The reservoir 6, that is shown only in part, includes an opening that is formed by a neck 61 in this embodiment. The capacity of the reservoir 6 can be constant, but it preferably varies, such that the working volume of the reservoir decreases as the fluid is extracted therefrom by the fluid dispenser member of the invention. In a practical embodiment, the reservoir 6 can include a follower piston or scraper that is displaced inside the reservoir in response to suction. In other words, the follower piston rises while it is being sucked up by the dispenser member.

In this non-limiting embodiment of the invention, the dispenser member comprises four component elements, namely a base body 1, a pusher 2, a piston 3, and a return and pre-compression spring 4. The dispenser member can optionally be provided with a protective cap 5 that comes to cover the pusher, so as to protect it and to prevent it from being actuated unintentionally or by accident. The dispenser member shown in the figures is a pump and this term is used to describe it in the description below.

The base body 1 is a circularly-symmetrical portion that can be made by injection-molding an appropriate plastics material. The body 1 presents an overall structure that is substantially cylindrical and concentric. Starting from the outside, the body 1 forms a fastener ring 11 that comes into engagement around the neck 61 of the reservoir 6. A bushing 12, that serves to guide the pusher 2 and that extends upwards in register with said ring 11. A self-sealing lip 13, that comes into leaktight contact with the inside of the neck 61 of the reservoir 6 and that extends in coaxial manner inside the ring 11. A crown 15, comprising a plurality of radial fins disposed in a star shape, is formed inside the lip 13. The crown forms a frustoconical hollow inside that advantageously corresponds to the shape of the top portion of the follower piston (not shown). In its center, the crown 15 forms an inlet that puts the inside of the reservoir 6 into communication with the inside of the pump. In particular, the inlet is defined by an inlet tube 17 that extends upwards from the crown 15. The inlet tube 17 also serves as an inlet-valve seat in co-operation with the piston 3. A main cylinder 16, that also co-operates with the piston 3, extends in co-axial manner outside the tube 17, as described below. A sleeve 14 also extends around the cylinder 16. A housing is thus defined between the cylinder 16 and the sleeve 14 that serves to receive the bottom end of the return and pre-compression spring 4. In addition, a housing is defined between the bushing 12 and the sleeve 14, in which housing the bottom end 26 of the pusher 2 is received in order to guide it axially. The top end of the bushing 12 can also be formed with an inner groove in which the protective cap 5 can be snap-fastened.

The pusher 2 comprises a bearing surface or plate 21 and a substantially-cylindrical peripheral skirt 22 that extends downwards from the outer periphery of the plate 21. The plate 21 advantageously presents a certain amount of elasticity, such that it deforms a little while sufficient pressure is being exerted thereon. The pusher 2 co-operates with the base body 1 by means of the bottom end 26 of the skirt 22 being engaged inside the guide bushing 12. To prevent the pusher 2 from becoming disengaged and thus define the top dead center point of the pusher, the bushing 12 and the bottom end 26 form abutment means. The rest position, shown in FIG. 1, is achieved under the action of the return spring 4 while no pressure is being exerted on the bearing plate 21. In the invention, the plate 21 forms an outlet-valve seat 25 that, in this embodiment, is in the form of an annular flange that projects downwards from the bottom wall of the plate 21. In addition, the skirt 22 forms a dispenser wall 23 that has a dispenser orifice 24 passing therethrough. In FIG. 1, and even more visible in FIGS. 2*a* and 2*b*, it can be seen that the dispenser wall 23 presents an outside surface 231 that slopes a little relative to the axis of symmetry. It should even be observed that the outside surface curves a little. In addition, the dispenser wall 23 includes an inside surface 232 that defines a top portion 234 that slopes relative to the axis X, and a bottom portion 233 that is substantially cylindrical and that serves as a cylinder for slidably-receiving the piston 3. As a result of the slope of the outside surface 231, the dispenser orifice 24 is formed at a location in which the dispenser wall is thin. The depth of the dispenser orifice from the inside surface to the outside surface is thus very small, and consequently defines an inscribed volume that is very small. It should also be observed that the seat 25 of the outlet valve is situated directly in the proximity of the dispenser orifice 24: they are separated only by an annular gap that is defined between the seat 25 and the inside surface 232.

Figure 2B:
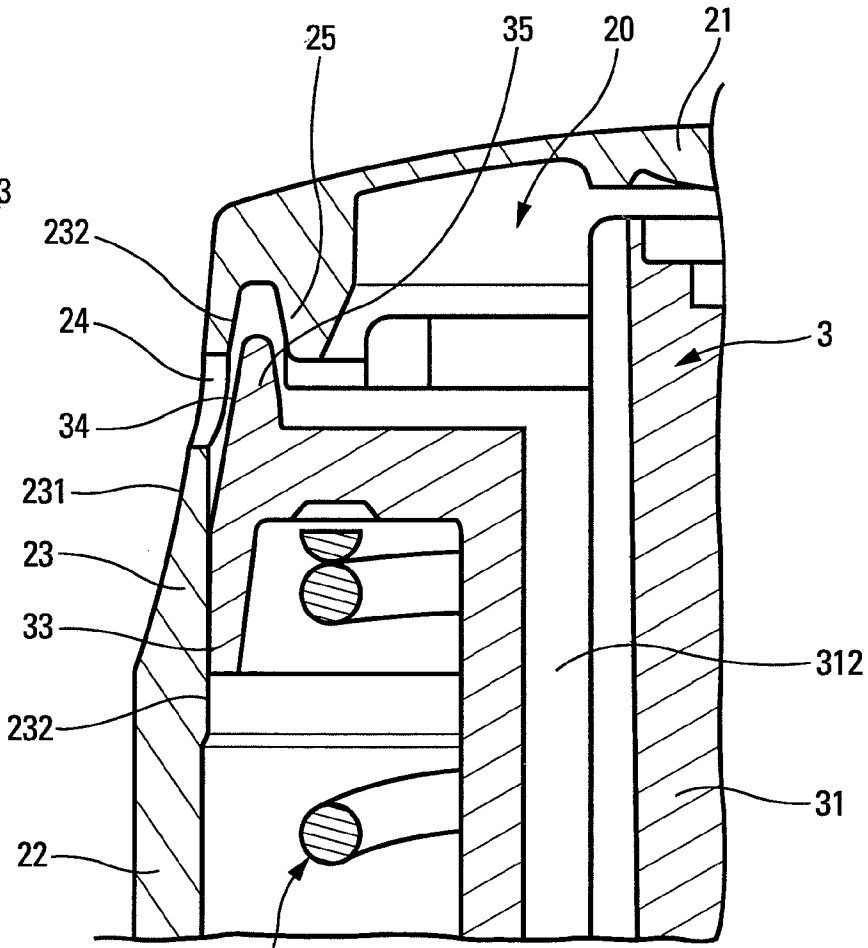
FIGS. 2*a* and 2*b* are very large-scale views of a detail of FIG. 1, respectively in the rest position and in the dispensing position.
Figure 2A:
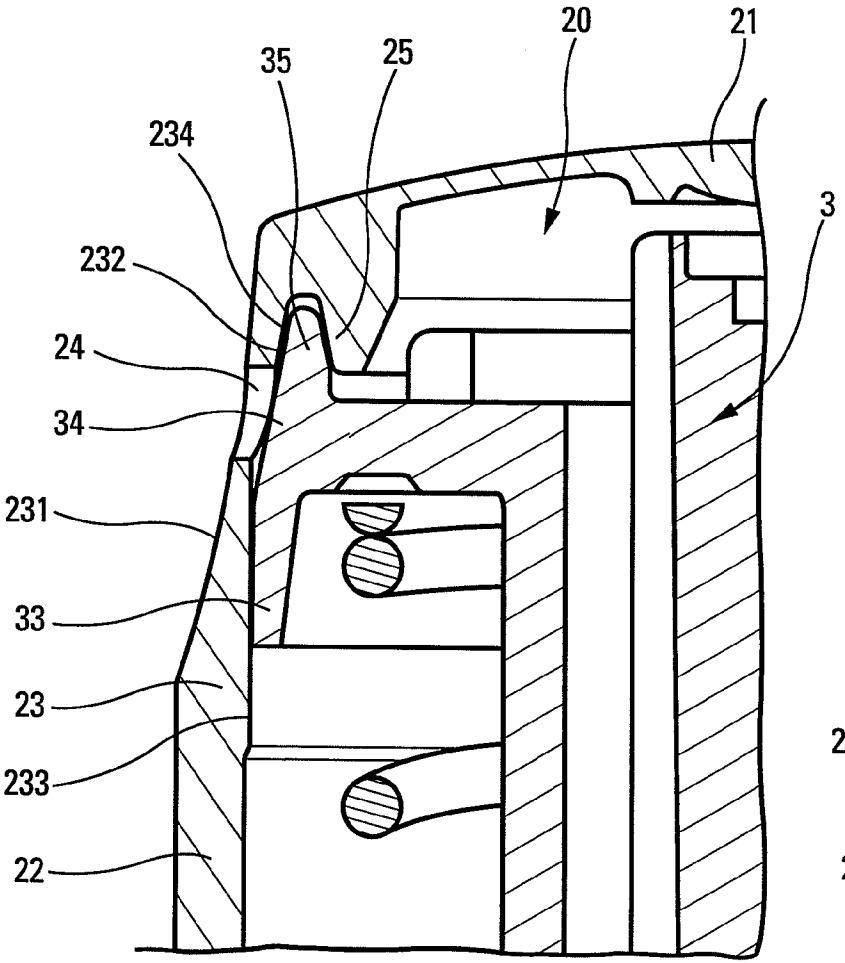

The piston is a piston of the differential type that is displaced along an axis X in response to a variation in the pressure inside the pump chamber that is designated overall by numerical reference 20. The piston 3 comprises a central axial trunk 31 that has a connection duct 312 passing therethrough. At its bottom end, the trunk 31 includes a main lip 36 that is engaged to slide in leaktight manner in the main cylinder 16 of the body 1. In addition, the trunk 31 defines a movable inlet-valve member 37 for selectively coming into leaktight contact inside the inlet tube 17. In this embodiment, the movable member 37 is in the form of a small tube that is axially displaceable both out of and into contact with the tube 17. At its top end, the trunk 31 defines a stud 311 that is situated just below the bearing plate 21. Thus, it should easily be understood that by deforming the plate 21, it is possible to put it into contact with the stud 311, and thereby displace the piston 3 inside the pusher 2. Furthermore, the piston 2 includes an annular radial flange 32 beneath which the return and pre-compression spring 4 bears. The spring thus surrounds the trunk 31 of the piston 3 in coaxial manner. For return purposes, its bottom end becomes housed between the cylinder 16 and the sleeve 14 of the body 1. The annular flange 32 is connected at its outer periphery to a ring that performs three functions. Firstly, the ring forms a valve lip or differential lip 33 that is in sliding contact inside the cylinder that is formed by the bottom portion 233 of the inside surface 232 of the dispenser wall 23. Secondly, the ring forms a movable outlet-valve member 35: the annular movable member 35 is for selectively coming into leaktight contact with the seat 25 that is formed by the plate 21. Thirdly, in the invention, the ring forms a closure wall 34 that is positioned over the dispenser orifice 24 beside the inside surface of the dispenser wall 23. This happens when the pump is in the rest position, as shown in FIGS. 1 and 2*a*. The closure wall 34 advantageously comes into leaktight contact with the inside surface 232 all around the dispenser orifice. As can be seen in FIG. 2*a*, it is advantageous for both the top portion of the ring forming the movable member 35 and a portion of the closure wall 34 to fill the entire volume defined between the seat 25 and the inside surface 232. Although a small gap appears to remain in FIG. 2*a*, it is possible to make the piston, and in particular the top portion of its ring, in such a manner as to match closely the shape of the plate 21 in its zone defined between the seat 25 and the inside surface 232 of the dispenser wall 23. In this way, there is little or no fluid stored between the outlet valve and the dispenser orifice 24. The risk of the fluid deteriorating is thus minimized. The only location in which fluid can remain is inside the dispenser orifice 24, which is of minimal volume, given the small thickness of the dispenser wall 23.

The dynamic operation of the pump is described briefly below. In the configuration in FIGS. 1 and 2*a*, the pump is in the rest position with its inlet valve open and its outlet valve closed. The return and pre-compression spring 4 urges the piston 3 against the pusher 2, thereby resulting in the bottom end 26 of the pusher 2 being in abutment in the guide bushing 12. By pressing on the plate 21, both the pusher 2 and the piston 3 are displaced until the tube 37 comes into leaktight contact inside the tube 17. The inlet valve is thus formed and the pump chamber 20 is isolated from the inside of the reservoir 6. By continuing to press on the plate 21, the pressure inside the chamber 20 increases until it exceeds the force exerted by the return and pre-compression spring 4. By continuing to press on the plate 21, the piston 3 is thus displaced independently of the pusher 2: this results in the outlet valve opening, thereby defining an outlet passage for the fluid under pressure. This dispensing configuration is shown in FIG. 2*b*. It can be seen clearly that the differential lip 33 has been displaced downwards in the slide cylinder 233, and that the top portion of the ring has been disengaged from the gap that is formed between the seat 25 and the inside surface 232. The chamber 20 thus communicates directly with the dispenser orifice 24. When the pressure inside the chamber decreases, the piston returns to its rest position shown in FIG. 2*a*. The outlet valve thus closes. The closure wall 34 once again closes the dispenser orifice 24. There remains little or no fluid between the outlet valve and the dispenser orifice 24.

The top portion 234 of the inside surface 232 presents a sloping or frustoconical configuration, and the closure wall 34 presents a similar sloping or frustoconical configuration, so as to make it possible to create intimate leaktight contact around the orifice. This characteristic makes it possible to avoid any jamming of the piston 3 inside the pusher 2, given that the leaktight contacts are cone-on-cone and not cylinder-on-cylinder.

The invention claimed is:

1. A fluid dispenser member comprising a dispenser wall (23) defining an outside surface (231) and an inside surface (232), said wall (23) having a dispenser orifice (24) passing therethrough, connecting the inside surface to the outside surface, the inside surface (232) forming a sealing slide-cylinder (233) for a piston (3) that is suitable for being displaced, from a rest position, along an axis X in said cylinder and with leaktight contact, so as to open an outlet valve (25, 35), said piston (3) forming a portion of a fluid chamber (20) in which fluid is selectively put under pressure and flows through the open outlet valve towards the dispenser orifice, the piston forming a closure wall (34) that is suitable for closing the dispenser orifice (24) in the rest position, the closure wall (34) being positioned, in the rest position, over the dispenser orifice (24) beside its inside surface (232), the closure wall (34) coming into leaktight contact with the inside surface (232), the dispenser member being characterized in that, at the dispenser orifice (24), the inside surface (232) slopes relative to the displacement axis X of the piston (3), and the closure wall (34) of the piston (3) slopes in a manner that substantially corresponds to the inside surface (232), so as to create a cone-on-cone contact.

2. A dispenser member according to claim 1, in which, at the dispenser orifice (24), the outside surface (231) slopes relative to the axis X.

3. A dispenser member according to claim 1, in which the dispenser wall (23) presents a thinner wall at the dispenser orifice (24).

4. A dispenser member according to claim 1, in which the piston (3) forms a movable outlet-valve member (35) for coming into leaktight contact against an outlet-valve seat (25).

5. A dispenser member according to claim 4, in which, a fluid passage is defined between the open outlet valve and the dispenser orifice, the passage being substantially filled in by the piston in the rest position, so as to reduce the dead volume.

6. A dispenser member according to claim 1, in which the piston (3) is a differential piston that is displaced in response to a variation in the pressure in the fluid chamber (20).

7. A dispenser member according to claim 1, in which the dispenser wall (23) is formed by a pusher (2) such that the piston (3) slides in the pusher, the outlet valve including a seat (25) that is formed by the pusher.

8. A dispenser member according to claim 7, in which the pusher comprises a bearing wall (21) and a substantially-cylindrical peripheral skirt (22), the dispenser wall (23) being formed by the skirt, the skirt including a bottom end (26) that is engaged in an axial guide bushing (12) that advantageously serves as a support for a protective cap (5).

9. A fluid dispenser member comprising:

a dispenser wall defining an outside surface and an inside surface, said dispenser wall comprising a dispenser orifice connecting the inside surface to the outside surface, the inside surface forming a sealing slide-surface for a piston displaceable along a displacement axis X from a rest position and in leaktight contact with the inside surface, so as to open an outlet valve of the dispenser member;

said piston forming a portion of a fluid chamber in which fluid is put under pressure and flows through the outlet valve when open towards the dispenser orifice, the piston forming a closure wall that closes the dispenser orifice in the rest position, the closure wall positioned, in the rest position, over the dispenser orifice, the closure wall coming into leaktight contact with the inside surface of the dispensing wall;

the inside surface of the dispensing wall slopes, at the dispenser orifice, relative to the displacement axis X, and the closure wall of the piston slopes at an inclination that substantially corresponds to the inside surface of the dispensing wall.

10. The fluid dispenser member according to claim 9, wherein the closure wall of the piston slopes at an inclination that substantially corresponds to the inside surface of the dispensing wall so as to create a cone-on-cone contact.

* * * * *